US007066838B2

(12) United States Patent
Iwami

(10) Patent No.: US 7,066,838 B2
(45) Date of Patent: Jun. 27, 2006

(54) MULTI-PIECE SOLID GOLF BALL

(75) Inventor: Satoshi Iwami, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/776,528

(22) Filed: Feb. 12, 2004

(65) Prior Publication Data

US 2004/0162161 A1 Aug. 19, 2004

(30) Foreign Application Priority Data

Feb. 13, 2003 (JP) ..... 2003-035030

(51) Int. Cl.
*A63B 37/06* (2006.01)

(52) U.S. Cl. ..... 473/374

(58) Field of Classification Search ..... 473/377, 473/373, 374, 370
See application file for complete search history.

(56) References Cited

U.S. PATENT DOCUMENTS 4,431,193 A * 2/1984 Nesbitt ..... 473/374
5,782,707 A 7/1998 Yamagishi et al.
5,820,486 A 10/1998 Tanaka et al.
5,885,172 A * 3/1999 Hebert et al. ..... 473/354
6,458,046 B1 * 10/2002 Halko et al. ..... 473/361
6,520,871 B1 * 2/2003 Sullivan et al. ..... 473/374
6,663,509 B1 * 12/2003 Nesbitt et al. ..... 473/377
2003/0232665 A1 * 12/2003 Sasaki et al. ..... 473/371
2004/0121856 A1 * 6/2004 Iwami ..... 473/371

FOREIGN PATENT DOCUMENTS

JP 9-38238 A 2/1997
JP 9-239068 A 9/1997

* cited by examiner

*Primary Examiner*—Raeann Gorden
(74) *Attorney, Agent, or Firm*—Birch, Stewart, Kolasch & Birch, LLP

(57) ABSTRACT

The present invention provides a multi-piece solid golf ball, of which durability is excellent and flight distance is improved by accomplishing high launch angle and low spin amount, when hit by golfers, who swing a golf club at low head speed, using a middle iron club to a driver. The present invention relates to a multi-piece solid golf ball comprising a center, an intermediate layer formed on the center and a cover covering the intermediate layer, wherein the intermediate layer is formed from a material having an elongation of 9 to 20 mm when applying the maximum load in penetration and impact fatigue tests and a flexural stiffness of 300 to 2,000 MPa.

11 Claims, 2 Drawing Sheets

MULTI-PIECE SOLID GOLF BALL

This Nonprovisional application claims priority under 35 U.S.C. § 119(a) on Patent Application No(s) 2003-35030 filed in Japan on Feb. 13, 2003, the entire contents of which are hereby incorporated by reference.

FIELD OF THE INVENTION

The present invention relates to a multi-piece solid golf ball. More particularly, it relates to a multi-piece solid golf ball, of which durability is excellent and flight distance is improved by accomplishing high launch angle and low spin amount, when hit by golfers, who swing a golf club at low head speed, using a middle iron club to a driver.

BACKGROUND OF THE INVENTION

In golf balls commercially selling, there are solid golf balls such as two-piece golf ball, three-piece golf ball and the like, and thread wound golf balls. Since the solid golf balls have excellent flight performance and durability as compared with the thread wound golf balls, the solid golf balls occupy the greater part of the golf ball market. However, in the solid golf ball, shot feel is hard and impact force at the time of hitting is large, and velocity at the time of hitting is large, which reduce the spin amount is small. Therefore, the solid golf ball is inferior to the thread wound golf ball in shot feel and controllability at approach shot.

Recently, the solid golf balls, of which flight distance can be improved while maintaining soft and good shot feel at the time of hitting as good as the conventional thread wound golf ball, generally occupy the greater part of the golf ball market. Multi-piece golf balls represented by three-piece golf ball have good shot feel while maintaining excellent flight performance, because they can vary hardness distribution, when compared with the two-piece golf ball.

Launch angle and backspin of golf ball have a great effect on trajectory of the golf ball hit by a golf club. The hit golf ball having large launch angle tends to have high trajectory, and the hit golf ball having small launch angle tends to have low trajectory. Since the backspin provides lift to the hit golf ball, the hit golf ball having large backspin amount tends to have high trajectory, and the hit golf ball having small backspin amount tends to have low trajectory. Performance requirements of golf balls from golfers include flight distance, shot feel, controllability and the like. When golfers use a golf club, particularly wood club (such as a driver), long iron club, middle iron club and the like, the flight distance is an important performance requirement.

In order to improve the flight distance when hit by a golf club such as a wood club, it is required for the hit golf ball to have high trajectory and long flight duration to a certain extent as well known. The hit golf ball having large launch angle and large backspin amount has high-trajectory as described above, but the hit golf ball having too large backspin amount tends to have short flight distance. It is reason that kinetic energy is consumed by backspin, and that force applied such that the hit golf ball is pulled backward occurs by the lift until the golf ball reaches the highest point of the trajectory because the lift is applied perpendicular to the flight direction of the golf ball. Therefore, golf ball, of which the backspin amount is not very large and high trajectory is accomplished by high launch angle, has long flight distance when hit by a golf club, such as a wood club.

Based on the above knowledge, there has been many developments of golf ball having long flight distance accomplished by low backspin amount and high launch angle at the time of hitting, while maintaining the other properties, such as good shot feel, controllability and durability, from the viewpoint of formulation of the material and structure of the golf ball (Japanese Patent Kokai Publication Nos. 38238/1997, 239068/1997 and the like).

In Japanese Patent Kokai Publication No. 38238/1997, a golf ball comprising a core and a cover covering the core is disclosed. The cover has a two-layer structure composed of an outer cover and an inner cover, the inner cover is prepared from a resin composition having a flexural modulus of 5,000 to 12,000 kgf/cm$^2$ at 23° C. and a relative humidity of 50%, and comprising a polyamide resin having a flexural modulus of 6,000 to 30,000 kgf/cm$^2$ at 23° C. and a relative humidity of 50% and a thermoplastic elastomer having a JIS-A hardness of 30 to 98, in a weight ratio of polyamide resin : thermoplastic elastomer within the range of 95:5 to 50:50.

In Japanese Patent Kokai Publication No. 239068/1997, a three-piece solid golf ball comprising a solid core, an intermediate layer and a cover is disclosed. The core has a center hardness in JIS-C hardness of not more than 75 and a surface hardness in JIS-C hardness of not more than 85, the surface hardness is higher than the center hardness by 8 to 20, and in the layer hardness in the JIS-C hardness is higher than the surface hardness of the core by not less than 5, a cover hardness in JIS-C hardness is lower than the intermediate layer hardness by not less than 5, and a ratio of the golf ball surface area occupied by the dimple to the total surface area of the golf ball is not less than 62%.

However, it has been required to improve the performances of the golf balls still more by golfers. Therefore, there has been no golf ball having excellent flight performance by accomplishing small backspin amount and high launch angle at-the time of hitting, while maintaining the above other properties.

OBJECTS OF THE INVENTION

A main object of the present invention is to provide a multi-piece solid golf ball, of which durability is excellent and flight distance is improved by accomplishing high launch angle and low spin amount, when hit by golfers, who swing a golf club at low head speed, using a middle iron club to a driver.

According to the present invention, the object described above has been accomplished by providing a multi-piece solid golf ball comprising a core consisting of a center, an intermediate layer and a cover; and by adjusting the elongation when applying the maximum load in penetration and impact fatigue tests and the flexural stiffness of the intermediate layer to specified ranges, thereby providing a multi-piece solid golf ball, of which durability is excellent and flight distance is improved by accomplishing high launch angle and low spin amount, when hit by golfers, who swing a golf club at low head speed, using a middle iron club to a driver.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustrating only, and thus are not limitative of the present invention, and wherein.

SUMMARY OF THE INVENTION

Figure 1:
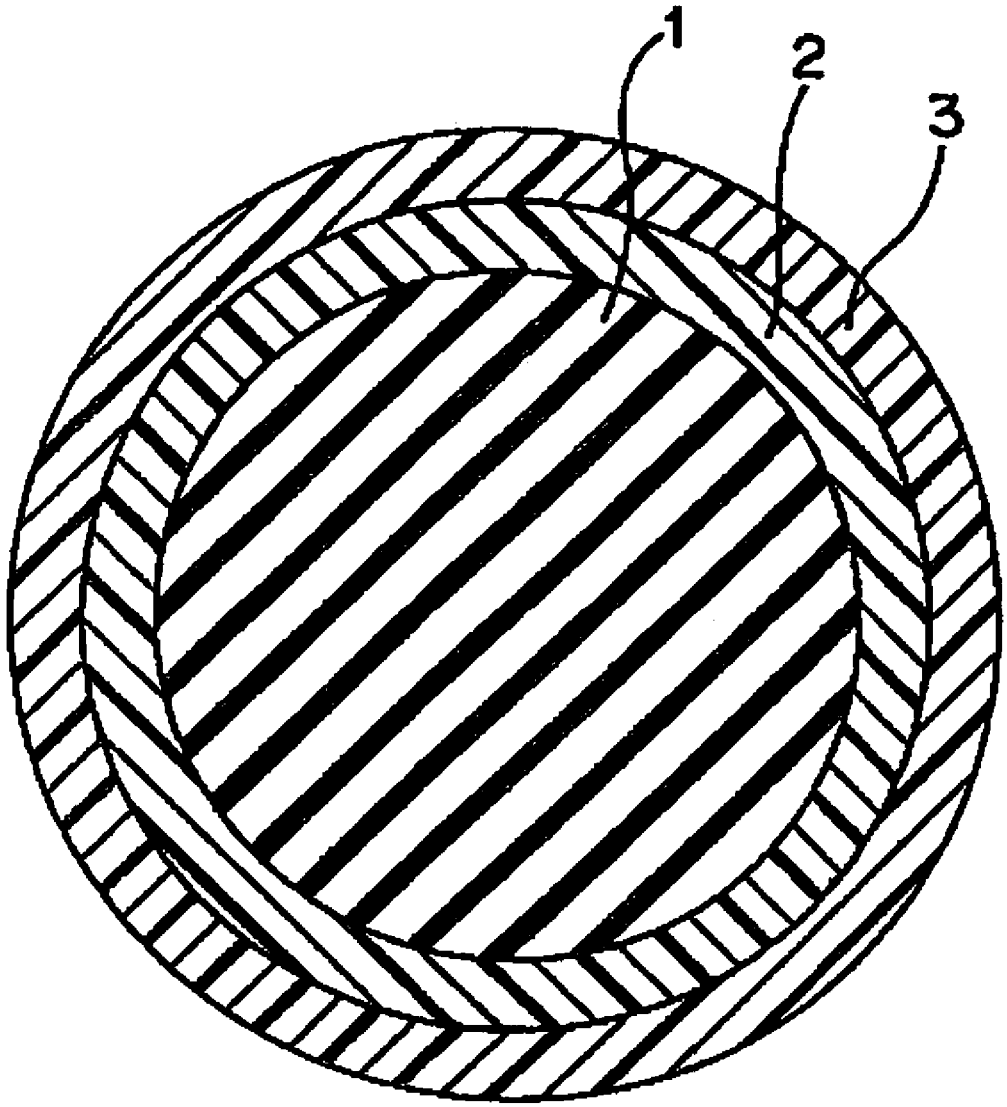
FIG. 1 is a schematic cross section illustrating one embodiment of the golf ball of the present invention.
Figure 2:
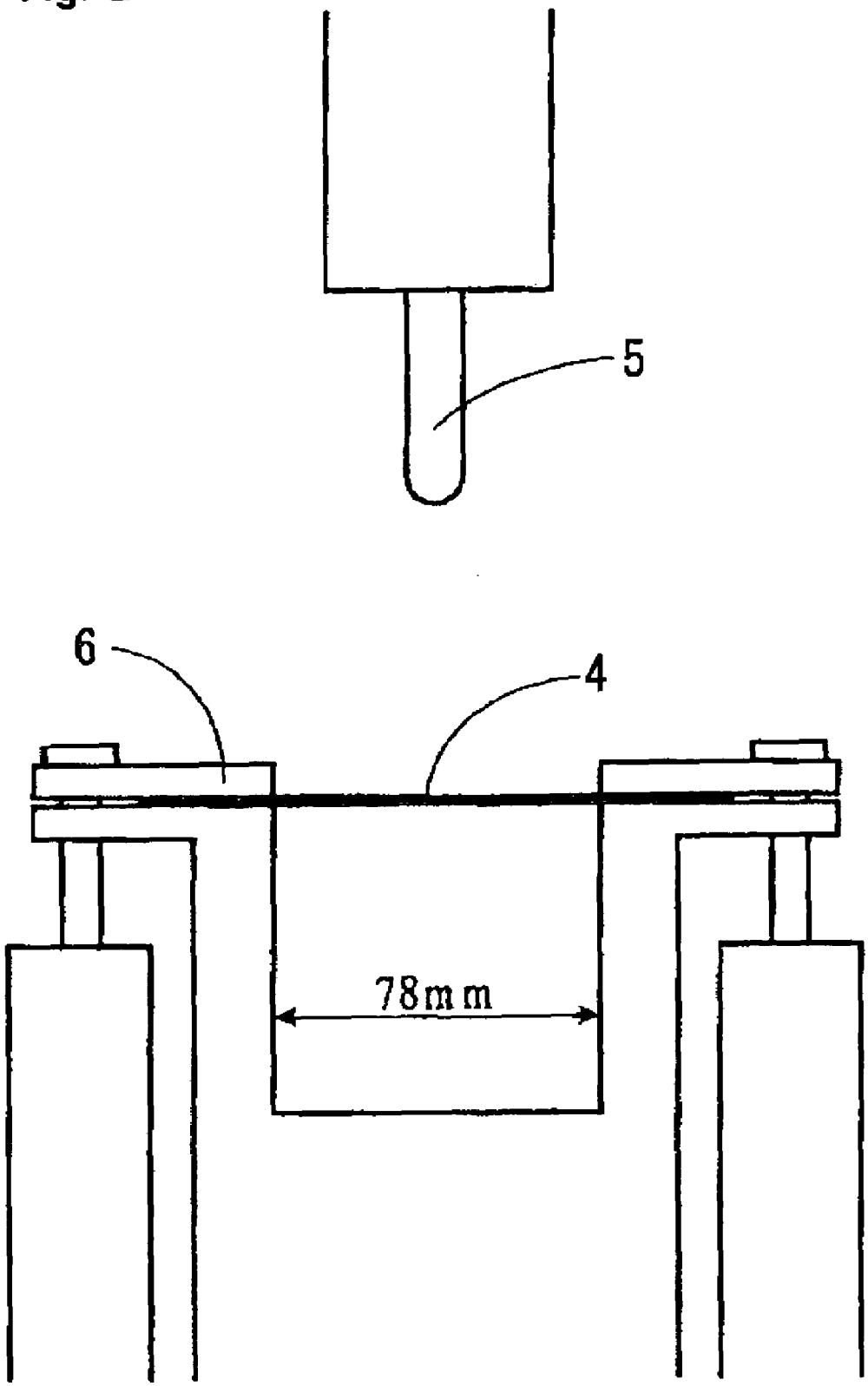
FIG. 2 is a schematic cross section of an equipment for penetration and impact fatigue tests explaining a measuring method of penetration and impact fatigue tests.

The present invention provides a multi-piece&solid golf ball comprising a center, an intermediate layer formed on the center and a cover covering the intermediate layer, wherein the intermediate layer is formed from a material having an elongation of 9 to 20 mm when applying the maximum load in penetration and impact fatigue tests and a flexural stiffness of 300 to 2,000 MPa.

In order to improve flight distance by accomplishing high launch angle and low spin amount of the golf ball, the present inventors have studied structure and material of the resulting golf ball. As a result, it was apparent that, while maintaining excellent durability, the flexural stiffness difference between the center and intermediate layer was large to accomplish high launch angle and low spin amount as an important factor of flight distance, which improves the flight distance, by using a material having high elongation of 9 to 20 mm when applying the maximum load in penetration and impact fatigue tests and high flexural stiffness of 300 to 2,000 MPa for the intermediate layer.

There have been golf balls obtained by using material having high flexural modulus or high hardness for the intermediate layer as prior art. It is possible in some degree to improve the balance of performances of the golf ball by using a hard intermediate layer in combination with a soft center and a soft cover. However, since the intermediate layer is hard when compared with the center and cover, stress is concentrated on the intermediate layer, and durability of the intermediate layer is degraded. Particularly, when using a harder intermediate layer than the golf ball of Japanese Patent Kokai Publication No. 239068/1997 as described above, the durability is greatly degraded. Therefore, in the present invention, the durability is sufficiently improved by forming the intermediate layer from a material that is hard and has large elongation. In the present invention, penetration mode, which is not tensile mode, is selected in an impact test, because it is considered that the penetration mode is similar to impact phenomenon when hit hitting the golf ball by a middle iron club to a driver.

In the golf ball of the present invention comprising a center, a intermediate layer and a cover;

rebound characteristics and durability are excellent by forming the intermediate layer from a material having an elongation of 9 to 20 mm when applying the maximum load in penetration and impact fatigue tests; and flight distance is improved by accomplishing high launch angle and low spin amount, when hit by a middle iron club to a driver, by forming the intermediate layer from a material having a flexural stiffness of 300 to 2,000 MPa. Therefore, in the present invention, a multi-piece solid golf ball, of which durability is excellent and flight distance is improved by accomplishing high launch angle and low spin amount, when hit by golfers, who swing a golf club at low head speed, using a middle iron club to a driver, can be accomplished.

In order to put the present invention into a more suitable practical application, it is preferable that the intermediate layer be formed from a material having an elongation of 9 to 16 mm when applying the maximum load in penetration and impact fatigue tests and a flexural stiffness of 350 to 1,500 MPa;

the intermediate layer be formed from a material selected from the group consisting of polyurethane-based thermoplastic elastomer, polyamide-based thermoplastic elastomer, polycarbonate resin, polyacetal resin, ionomer resin and a modified compound thereof;

the intermediate layer has a thickness of 0.3 to 2.0 mm; and the intermediate layer is formed from one material.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a center 1, an intermediate layer 2 formed on the center and a cover 3 covering the intermediate layer. The center 1 is obtained by press-molding a rubber composition under applied heat by using a method and condition, which has been conventionally used for preparing solid cores of golf balls. The rubber composition contains a base rubber, a co-crosslinking agent, an organic peroxide, a filler and the like.

The base rubber used for the center of the present invention may be synthetic rubber, which has been conventionally used for cores of solid golf balls. Preferred is high-cis polybutadiene rubber containing a cis-1,4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be.,.-unsaturated carboxylic acid having 3 to 8 carbon atoms (such as acrylic acid, methacrylic acid, etc.) or mono or divalent metal salts thereof, such as zinc or magnesium salts thereof, or mixtures thereof. The preferred co-crosslinking agent is zinc diacrylate, because it imparts high rebound characteristics to the resulting golf ball. The amount of the co-crosslinking agent is from 20 to 40 parts by weight, preferably from 22 to 35 parts by weight, more preferably from 22 to 32 parts by weight, based on 100 parts by weight of the base rubber. When the amount of the co-crosslinking agent is smaller than 20 parts by weight, the vulcanization degree of the rubber composition is not sufficiently obtained, and the center is too soft. Therefore, the rebound characteristics of the resulting golf ball are degraded, which reduces the flight distance. On the other hand, when the amount of the co-crosslinking agent is larger than 40 parts by weight, the resulting golf ball is too hard, and the shot feel is poor.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy)hexane, di-t-butyl peroxide and the like. The preferred organic peroxide is dicumyl peroxide. The amount of the organic peroxide is from 0.1 to 3.0 parts by weight, preferably 0.1 to 2.8 parts by weight, more preferably 0.2 to 2.5 parts by weight, based on 100 parts by weight of the base rubber. When the amount of the organic peroxide is smaller than 0.1 parts by weight, the center is too soft, and the rebound characteristics of the resulting golf ball are degraded, which reduces the flight distance. On the other hand, when the amount of the organic peroxide is larger than 3.0 parts by weight, the center is too hard, and the shot feel of the resulting golf ball is poor.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and the mixture thereof. The amount of the filler, which can vary depending to the specific gravity, size and the like of the cover and center, is not limited, but is from 5 to 50 parts by weight, based on 100 parts by weight of the base rubber, which can be typically used for the core of solid golf ball.

The rubber compositions for the center 1 of the golf ball of the present invention can contain other components, which have been conventionally used for preparing the core of solid golf balls, such as antioxidant or peptizing agent, sulfur and the like. If used, the amount of the antioxidant is preferably from 0.1 to 2.0 parts by weight, the amount of the peptizing agent is preferably from 0.1 to 2.0 parts by weight, the amount of the sulfur is preferably from 0.01 to 1.0 parts by weight, based on 100 parts by weight of the base rubber.

The center 1 used for the golf ball of the present invention is obtained by vulcanizing and press-molding under applied heat the rubber composition in a mold. The vulcanization may be conducted, for example, by press molding at 130 to 180° C. and 2.8 to 9.8 MPa for 15 to 50 minutes, but the condition thereof is not particularly limited.

In the golf ball of the present invention, the center 1 has a diameter of 37.2 to 41.2 mm, preferably 38.4 to 41.2 mm, more preferably 39.4 to 40.8 mm. When the diameter of the center is smaller than 37.2 mm, the thickness of the intermediate layer or cover is large. When the thickness of the intermediate layer is large, the resulting golf ball is too hard, and when the thickness of the cover is large, the rebound characteristics of the resulting golf ball are degraded. On the other hand, when the diameter of the center is larger than 41.2 mm, the thickness of the intermediate layer or cover is small, the durability of resulting golf ball is poor.

In the golf ball of the present invention, it is desired for the center 1 to have a deformation amount when applying from an initial load of 98 N to a final load of 1275 N of 3.0 to 6.0 mm, preferably 3.3 to 5.5 mm, more preferably 3.5 to 5.0 mm. When the deformation amount of the center is smaller than 3.0 mm, the center is too hard, and it is difficult to deform the center at the time of hitting, which degrades the shot feel of the resulting golf ball. On the other hand, when the deformation amount is larger than 6.0 mm, the center excessively deforms at the time of hitting, which degrades the durability. The intermediate layer 2 is then formed on the center 1.

In the golf ball of the present invention, it is required for the intermediate layer to have an elongation when applying the maximum load in penetration and impact fatigue tests of 9 to 20 mm, preferably 9 to 18 mm, more preferably 10 to 16 mm, most preferably 10 to 12 mm. When the elongation is smaller than 9 mm, the durability is degraded. On the other hand, when the elongation is larger than 20 mm, the hardness of the material itself for the intermediate layer is too low.

The elongation when applying the maximum load in penetration and impact fatigue tests is determined by penetration and impact fatigue tests, using a sample having a size of 100 mm×100 mm×1 mm cut out from a heat and press molded sheet (slab) having a thickness of about 1 mm from the intermediate layer composition, with a falling-weight type impact test equipment, "Dynatup-8250" manufactured by General Research Co. The sample is completely clamped with a support ring having an inner diameter of 78 mm, and a striker having half-spherical tip shape, a total weight of 5.91 kg and a diameter of the tip of 10 mm is dropped at an impact speed of 4 m/sec to penetrate the sample. The test temperature is 23° C. The elongation when applying the maximum load is determined by measuring a displacement of the striker (elongation) and a load by computerization.

In the golf ball of the present invention, it is required for the intermediate layer to be formed from a material having a flexural stiffness of 300 to 2,000 MPa, preferably 350 to 1,500 MPa, more preferably 400 to 1,300 MPa. When the flexural stiffness of the material for the intermediate layer is lower than 300 MPa, the technical effects accomplished by high launch angle and low spin amount are not sufficiently obtained. On the other hand, when the flexural stiffness of the material for the intermediate layer is higher than 2,000 MPa, the shot feel is hard and poor. In addition, the durability is poor.

The flexural stiffness is flexural stiffness measured according to JIS K 7106, using a sample of heat and press molded sheet (slab) having a thickness of about 2 mm from the material for the intermediate layer, which had been stored at 23° C. for 2 weeks.

In the golf ball of the present invention, a material for the intermediate layer is not limited as long as the material has the specified elongation when applying the maximum load in penetration and impact fatigue tests and the specified flexural stiffness as described above, but it is preferable for the intermediate layer to be formed from only one material. If using a blend of two or more materials, as compared with solely using one material, the durability is mainly degraded and the rebound characteristics are also degraded. Detailed mechanism thereof has not been known, but it is considered that the compatibility between the materials for the intermediate layer is degraded and the dispersibility of the whole intermediate layer is degraded.

In the golf ball of the present invention, the intermediate layer is formed from only one material having an elongation when applying the maximum load in penetration and impact fatigue tests of 9 to 20 mm and a flexural stiffness of 300 to 2,000 MPa as described above. Therefore, the resulting intermediate layer 2 formed from the material has the values of the elongation and the flexural stiffness.

In the golf ball of the present invention, the material for the intermediate layer 2 is not limited as long as the intermediate layer is formed from the material having the above values of the elongation and flexural stiffness, but the intermediate layer is preferably formed from a material selected from the group consisting of polyurethane-based thermoplastic elastomer, polyamide-based thermoplastic elastomer, polycarbonate resin, polyacetal resin, ionomer resin and a modified compound thereof.

Concrete examples of the materials for the intermediate layer include thermoplastic elastomers, such as polyurethane-based thermoplastic elastomer, commercially available from BASF Japan Co., Ltd. under the trade name "Elastollan XHM76D", polyamide-based thermoplastic elastomer, which is commercially available from Atofina Japan Co., Ltd. under the trade name of "Pebax 7233" and the like; polycarbonate resin (Polymer alloy (PC/ABS) grade), commercially available from Mitsubishi Engineering-Plastics Corporation under the trade name "Iupilon" (such as "Iupilon PM1220") and a modified compound thereof; polyacetal resin, commercially available from Mitsubishi Engineering-Plastics Corporation under the trade name Iupital (such as "Iupital FU2025") and a modified compound thereof; ionomer resin, commercially available from Du Pont Co. under the trade name "Surlyn" (such as "Surlyn 8140 (Na)", "Surlyn 8150 (Na)", "Surlyn 8945 (Na)", "Surlyn 9120 (Zn)", "Surlyn 9150 (Zn)", "Surlyn 9945 (Zn)", "Surlyn 6120 (Mg)", "Surlyn AD8546 (Li)", "Surlyn 7930 (Li)", "Surlyn 7940 (Li)"), ionomer resin, commercially available from Du Pont-Mitsui Polychemicals Co., Ltd. under the trade name "Hi-milan" (such as "Hi-milan 1605 (Na)", "Hi-milan 1707 (Na)", "Hi-milan 1706 (Zn)", "Hi-milan AM7311 (Mg)"1855) and a modified compound thereof by metal salt or higher fatty acid metal salt; and the like.

The wording "the intermediate layer is formed from (only) one material" as used herein means that the material for the intermediate layer may contain a small amount of a material, which has few effects on the dispersibility and compatibility thereof, for example, in the amount of smaller than 3 parts by weight, based on 100 parts by weight of the material for the intermediate layer.

A method of covering the center 1 with the intermediate layer 2 is not specifically limited, but may be conventional methods, which have been known to the art and used for forming the cover of the golf balls. For example, there can be used a method comprising molding the intermediate layer composition into a semi-spherical half-shell in advance, covering the center with the two half-shells, followed by press molding, or a method comprising injection molding the intermediate layer composition directly on the center, which is covered with the cover, to cover it. The injection molding is suitably used in view of moldability.

In the golf ball of the present invention, it is desired for the intermediate layer 2 to have a thickness of 0.3 to 2.0 mm, preferably 0.5 to 1.8 mm, more preferably 0.8 to 1.5 mm. When the thickness of the intermediate layer is smaller than 0.3 mm, the technical effects accomplished by high flexural stiffness of the intermediate layer are not sufficiently obtained. On the other hand, when the thickness of the intermediate layer is larger than 2.0 mm, the resulting golf ball is too hard, and the shot feel is hard and poor. The cover 3 is then covered on the intermediate layer 2.

The materials for the cover used in the golf ball of the present invention, which may be thermoplastic resin or thermosetting resin, are not limited, but are selected from the group consisting of thermoplastic elastomer, such as polyurethane-based thermoplastic elastomer, polyolefin-based thermoplastic elastomer, polyester-based thermoplastic elastomer, polyamide-based thermoplastic elastomer, polystyrene-based thermoplastic elastomer, and mixtures thereof or modified compounds thereof. Preferred is polyurethane-based thermoplastic elastomer in view of scuff resistance and controllability.

Concrete examples of the materials for the cover include polyurethane-based elastomer, which is commercially available from BASF Japan Co., Ltd. under the trade name of "Elastollan" (such as "Elastollan XNY97A"); olefin-based thermoplastic elastomer available from Mitsubishi Chemical Co., Ltd. under the trade name "Thermoran" (such as "Thermoran 3981N"); polyolefin-based thermoplastic elastomer, which is commercially available from Sumitomo Chemical Co., Ltd. under the trade name of "Sumitomo TPE" (such as "Sumitomo TPE3682" and "Sumitomo TPE9455"); polyester-based thermoplastic elastomer, which is commercially available from Toray-Du Pont Co., Ltd. under the trade name of "Hytrel" (such as "Hytrel 3548", "Hytrel 4047"); polyamide-based thermoplastic elastomer, which is commercially available from Atofina Japan Co., Ltd. under the trade name of "Pebax" (such as "Pebax 2533"); styrene-based thermoplastic elastomer available from Asahi Kasei corporation under the trade name "Tuftec" (such as "Tuftec H1051"); and the like.

The composition for the cover 3 used in the present invention may optionally contain fillers (such as barium sulfate), pigments (such as titanium dioxide) and the other additives such as a dispersant, an antioxidant, a UV absorber, a photostabilizer and a fluorescent agent or a fluorescent brightener, etc., in addition to the resin component as long as the addition of the additives does not deteriorate the desired performance of the golf ball cover. If used, the amount of the pigment is preferably 0.1 to 5.0 parts by weight, based on 100 parts by weight of the base resin for the cover.

A method of covering on the intermediate layer 2 with the cover 3 may be the same as the method of covering the center 1 with the intermediate layer 2. In the golf ball of the present invention, it is desired for the cover 3 to have a thickness of 0.3 to 2.0 mm, preferably 0.5 to 1.6 mm, more preferably 0.8 to 1.2 mm. When the thickness is smaller than 0.3 mm, it is difficult to mold the cover. On the other hand, when the thickness is larger than 2.0 mm, the rebound characteristics of the resulting golf ball are degraded.

In golf ball of the present invention, it is desired for the cover 3 to have a Shore D hardness of 20 to 55, preferably 25 to 52, more preferably 30 to 50. When the cover hardness is lower than 20, the cover is too soft, and the rebound characteristics of the resulting golf ball are degraded. On the other hand, when the cover hardness is higher than 55, the cover is too hard, and the spin amount at approach shot is too small, which degrades the controllability. The term "an intermediate layer hardness" or "a cover hardness" as used herein refers to the hardness measured using a sample of a stack of the three or more heat and press molded sheets having a thickness of about 2 mm from the intermediate layer composition or the cover composition, which had been stored at 23° C. for 2 weeks.

It has been well known in golf ball comprising a center, an intermediate layer and a cover that the intermediate layer is formed from soft material as described in the above Japanese Patent Kokai Publication No. 239068/1997. It is possible in some degree to improve the balance of performances of the golf ball by using hard intermediate layer in combination with soft center and soft cover. However, since the intermediate layer is hard when compared with the center and cover, stress is concentrated on the intermediate layer, and durability of the intermediate layer is degraded. Particularly, when using harder intermediate layer than the golf ball of Japanese Patent Kokai Publication No. 239068/1997, the durability is greatly degraded. Therefore, in the present invention, the durability is also sufficiently improved by forming the intermediate layer from a material that is hard and has large elongation.

The present invention is the most effective when using the above intermediate layer in combination with

- soft center (having a deformation amount when applying from an initial load of 98 N to a final load of 1275 N of 3.0 to 6.0 mm),
- soft cover (having a hardness in Shore D hardness of 20 to 55), and
- thin cover (having a thickness of 0.3 to 2.0 mm).

When the above combination,

- shot feel is soft and good by using soft center,
- flight distance is improved by accomplishing high launch angle and low spin amount, by using hard intermediate layer, durability is good by using soft cover, and rebound characteristics are improved, which increases the flight distance, by using thin cover. Therefore, in the present invention, technical effects of providing a golf ball, of which the flight distance, shot feel and controllability are excellent, can be also accomplished.

When using polyurethane-based thermoplastic elastomer for the cover, strain at the surface of the golf ball by club face at the time hitting is large, and it is problem that stress applying to the intermediate layer is also large. However, the problem in the polyurethane-based thermoplastic elastomer cover is solved by the above technique of the present invention.

At the time of molding the cover, many depressions called "dimples" are formed on the surface of the golf ball. Furthermore, paint-finishing or marking with a stamp may be optionally provided after the cover is molded for commercial purposes. The golf ball of the present invention is formed, so that it has a diameter of not less than 42.67 mm (preferably 42.67 to 42.82 mm) and a weight of not more than 45.93 g, in accordance with the regulations for golf balls.

In the golf ball of the present invention, it is desired to have a deformation amount when applying from an initial load of 98 N to a final load of 1275 N of 2.4 to 3.5 mm, preferably 2.5 to 3.2 mm, more preferably 2.6 to 3.0 mm. When the deformation amount is smaller than 2.4 mm, the golf ball is too hard, and the shot feel is hard and poor. On the other hand, when the deformation amount is larger than 3.5 mm, the golf ball is too soft, and the shot feel is heavy and poor.

EXAMPLES

The following Examples and Comparative Examples further illustrate the present invention in detail but are not to be construed to limit the scope of the present invention.

Production of Center

The rubber compositions for the center having the formulation shown in Table 1 were mixed with a mixing roll, and the mixtures were then press-molded at 170° C. for 15 minutes in the mold to obtain spherical center having a diameter of 38.4 mm. The deformation amount of the resulting center was measured, and the result is shown in the same Table. The test method is described later.

TABLE 1

(parts by weight)

| | Center composition | | | | |
|---|---|---|---|---|---|
| | A | B | C | D | E |
| BR-18 *1 | 100 | 100 | 100 | 100 | 100 |
| Zinc diacrylate | 30.0 | 29.0 | 27.5 | 26.0 | 24.5 |
| Zinc oxide | 5.0 | 5.0 | 5.0 | 5.0 | 5.0 |
| Barium sulfate | 17.5 | 15.0 | 9.5 | 5.0 | 10.0 |
| Dicumyl peroxide *2 | 0.8 | 0.8 | 0.8 | 0.8 | 0.8 |
| Diphenyl disulfide *3 | 0.5 | 0.5 | 0.5 | 0.5 | 0.5 |
| Deformation amount (mm) | 3.55 | 3.60 | 4.20 | 4.40 | 4.60 |

*1 High-cis polybutadiene commercially available from JSR Co., Ltd., under the trade name "BR-18" (Content of cis-1,4-polybutadiene = 96%)
*2 Dicumyl peroxide, commercially available from Nippon Oil & Fats Co., Ltd. under the trade name of "Percumyl D"
*3 Diphenyl disulfide, commercially available from Sumitomo Seika Co., Ltd.

Preparation of Intermediate Layer and Cover Compositions

The formulation materials for the intermediate layer and cover showed in Tables 2 and 3 were mixed using a kneading type twin-screw extruder to obtain pelletized intermediate layer and cover compositions. The extrusion condition was, a screw diameter of 45 mm, a screw speed of 200 rpm, and a screw L/D of 35.

The formulation materials were heated at 200 to 260° C. at the die position of the extruder. The elongation when applying the maximum load in penetration and impact fatigue tests of the intermediate layer was determined by penetration and impact fatigue tests, using a sample having a size of 100 mm×100 mm×3 mm cut out from a heat and press molded sheet (slab) having a thickness of about 3 mm from the intermediate layer composition, with a falling-weight type impact test equipment, "Dynatup-8250" manufactured by General Research Co. The flexural stiffness of the intermediate layer and cover was measured according to JIS K 7106, using a sample of a heat and press molded sheets (slab) having a thickness of about 2 mm from the resulting intermediate layer and cover compositions, which had been stored at 23° C. for 2 weeks. The results are shown in Tables 2 to 5. The cover hardness was measured using a Shore D hardness meter according to ASTM-D2240, using a sample of a stack of the three or more heat and press molded sheets having a thickness of about 2 mm from the resulting cover compositions, which had been stored at 23° C. for 2 weeks. The results are shown in Table 4 (Examples) and Table 5 (Comparative Examples).

TABLE 2

| Intermediate layer and cover composition | I | II | III | IV |
|---|---|---|---|---|
| Pebax 7233 *4 | 100 | — | — | — |
| Elastollan XHM76D *5 | — | 100 | — | — |
| Iupital FU2025 *6 | — | — | 100 | — |
| Iupilon PM1220 *7 | — | — | — | 100 |
| Novatec XK1181 *8 | — | — | — | — |
| Novadurn 5503R1 *9 | — | — | — | — |
| Elastollan XNY97A *10 | — | — | — | — |
| Titanium dioxide | — | — | — | — |
| Flexural stiffness (MPa) | 420 | 700 | 900 | 1200 |

TABLE 3

| Intermediate layer and cover composition | V | VI | VII | VIII |
|---|---|---|---|---|
| Pebax 7233 *4 | — | — | — | — |
| Elastollan XHM76D *5 | — | — | — | — |
| Iupital FU2025 *6 | — | — | — | — |
| Iupilon PM1220 *7 | — | — | — | — |
| Novatec XK1181 *8 | 100 | — | — | — |
| Novadurn 5503R1 *9 | — | 100 | — | — |
| Elastollan XNY97A *10 | — | — | — | 100 |
| Hi-milan 1555 *11 | | | 100 | |
| Titanium dioxide | — | — | — | 2 |
| Flexural stiffness (MPa) | 500 | 1000 | 200 | 40 |

*4: Pebax 7233 (trade name), polyamide-based thermoplastic elastomer, commercially available from Atofina Japan Co., Ltd.; Flexural stiffness=420 MPa

*5: Elastollan XHM76D (trade name), polyurethane-based thermoplastic elastomer formed by using 4,4'-diphenylmethane diisocyanate, commercially available from BASF Japan Co., Ltd.; Flexural stiffness=700 MPa

*6: Iupital FU2025 (trade-name), polyacetal resin (Impact resistance grade), commercially available from Mitsubishi Engineering-Plastics Corporation; Flexural stiffness=900 MPa

*7: Iupilon PM1220 (trade name), polycarbonate resin (Polymer alloy (PC/ABS) grade), commercially available from Mitsubishi Engineering-Plastics Corporation; Flexural stiffness=1200 MPa

*8: Novatec XK1181 (trade name), polypropylene resin, commercially available from Japan Polychem Corporation; Flexural stiffness=500 MPa

*9: Novadurn 5503R1 (trade name), polybutylene terephthalate, commercially available from Mitsubishi Engineering-Plastics Corporation; Flexural stiffness=1000 MPa

*10: Elastollan XNY97A (trade name), polyurethane-based thermoplastic elastomer formed by using 4,4'-dicyclohexylmethane diisocyanate ($H_{12}$MDI)-polyoxytetramethylene glycol (PTMG), commercially available from BASF Japan Co., Ltd.; Shore A (JIS-A) hardness=97, Flexural stiffness =40 MPa

*11: Hi-milan 1555 (trade name), ethylene-methacrylic acid copolymer ionomer resin obtained by neutralizing with sodium ion, manufactured by Du Pont-Mitsui Polychemicals Co., Ltd.; Flexural stiffness=200 MPa

Formation of the Intermediate Layer

The resulting intermediate layer compositions were covered on the center by injection molding to form a intermediate layer having a thickness of 1.4 mm.

Examples 1 to 4 and Comparative Examples 1 to 3

The cover compositions were covered on the intermediate layer by injection molding using a mold having dimples to form a cover layer having a thickness of 0.8 mm. After deflashing, paint was applied on the surface to obtain golf ball having a diameter of 42.8 mm and a weight of 45.4 g. With respect to the resulting golf balls, the deformation amount, flight performance (launch angle, spin amount and flight distance) and durability were measured. The results are shown in the Table 4 (Examples) and Table 5 (Comparative Examples). The test methods are as follows.

Test Methods

(1) Deformation Amount

The deformation amount of the center or golf ball was determined by measuring a deformation amount when applying from an initial load of 98 N to a final load of 1275 N on the center or golf ball.

(2) Cover Hardness

The cover hardness was determined by measuring a Shore D hardness, using a sample of a stack of the three or more heat and press molded sheets having a thickness of about 2 mm from the cover composition, which had been stored at 23° C. for 2 weeks. The Shore D hardness was measured by using an automatic rubber hardness tester (type LA1), which is commercially available from Kobunshi Keiki Co., Ltd., with a Shore D hardness meter according to ASTM D 2240.

(3) Flight Distance

After a No.1 wood club (W#1, a driver) having a metal head was mounted to a swing robot manufactured by True Temper Co. and the golf ball was hit at a head speed of 45 m/sec, the launch angle and spin amount (backspin amount) immediately after hitting, and flight distance were measured. As the flight distance, carry that is a distance to the drop point of the hit golf ball was measured. The measurement was conducted 5 times for each golf ball (n=5), and the average is shown as the result of the golf ball. The flight distance is indicated by an index when that of Example 1 is 100.

(4) Penetration and Impact Fatigue Tests

The penetration and impact fatigue tests were conducted by using a falling-weight type impact test equipment, "Dynatup-8250" manufactured by General Research Co. A sample having a size of 100 mm×100 mm×1 mm was completely clamped with a support ring having an inner diameter of 78 mm, and a striker was dropped at an impact speed of 4 m/sec to penetrate the sample. The striker used has half-spherical tip shape, a total weight of 5.91 kg and a diameter of the tip of 10 mm. The test temperature is 23° C. The elongation when applying the maximum load is determined by measuring a displacement of the striker (elongation) and a load by computerization. The result is shown as the elongation in the penetration and impact fatigue tests.

(5) Durability

A No. 1 wood club (W#1, a driver) having metal head was mounted to a swing robot manufactured by True Temper Co. and the resulting golf ball was hit at a head speed of 45 m/second, repeatedly. The durability is the number of hit until the cover of the-golf ball cracks, and is indicated by an index when that of Example 3 is 100. The larger the number is, the better durability the golf ball has.

Test Results

TABLE 4

| | Example No. | | | |
|---|---|---|---|---|
| Test item | 1 | 2 | 3 | 4 |
| (Center) | | | | |
| Composition | B | C | D | E |
| (Intermediate layer) | | | | |
| Composition | I | II | III | IV |
| Flexural stiffness (MPa) | 420 | 700 | 900 | 1200 |
| Elongation (penetration) (mm) | 9.5 | 10 | 9 | 10.5 |
| (Cover) | | | | |
| Composition | VIII | VIII | VIII | VIII |
| Hardness (Shore D) | 47 | 47 | 47 | 47 |
| (Golf ball) | | | | |
| Deformation amount (mm) | 2.76 | 2.78 | 2.72 | 2.64 |
| (Flight performance) | | | | |
| Launch angle (degree) | 11.4 | 11.5 | 11.6 | 11.7 |
| Spin amount (rpm) | 2890 | 2870 | 2850 | 2800 |
| Flight distance | 100 | 101 | 102 | 103 |
| Durability | 105 | 110 | 100 | 115 |

TABLE 5

| Test item | Comparative Example No. 1 | 2 | 3 |
|---|---|---|---|
| (Center) | | | |
| Composition | A | C | B |
| (Intermediate layer) | | | |
| Composition | V | VI | VII |
| Flexural stiffness (MPa) | 500 | 1000 | 200 |
| Elongation (penetration) (mm) | 5 | 3 | 18 |
| (Cover) | | | |
| Composition | VIII | VIII | VIII |
| Hardness (Shore D) | 47 | 47 | 47 |
| (Golf ball) | | | |
| Deformation amount (mm) | 2.61 | 2.52 | 3.08 |
| (Flight performance) | | | |
| Launch angle (degree) | 10.6 | 10.5 | 10.3 |
| Spin amount (rpm) | 3150 | 3250 | 3400 |
| Flight distance | 97 | 96 | 93 |
| Durability | 70 | 50 | 120 |

As is apparent from Tables 4 to 5, the golf balls of Examples 1 to 4 of the present invention, when compared with the golf balls of Comparative Examples 1 to 3, have good durability, and have long flight distance by accomplishing high launch angle and low spin amount.

On the other hand, in the golf ball of Comparative Example 1, since the elongation in the penetration and impact fatigue tests is small, the deformation amount of the intermediate layer can not follow that of the resulting golf ball, and deformation loss occurs. Therefore, the launch angle is small and the spin amount is large, which reduces the flight distance. In addition, the durability is poor. In the golf ball of Comparative Example 2, since the elongation in the penetration and impact fatigue tests is small, the deformation amount of the intermediate layer can not follow that of the resulting golf ball, and deformation loss occurs, and the deformation amount of the resulting golf ball is too small. Therefore, the launch angle is small and the spin amount is large, which reduces the flight distance. In addition, the durability is poor.

In the golf ball of Comparative Example 3, since the flexural stiffness of the intermediate layer is low, the launch angle is small and the spin amount is large, which reduces the flight distance.

What is claimed is:

1. A multi-piece solid golf ball comprising a center, an intermediate layer formed on the center and cover covering the intermediate layer, wherein the core has a deformation amount when applying from an initial load of 98 N to a final load of 1275 N of 3.0 to 6.0 mm the intermediate layer is formed from a material having an elongation of 9 to 20 mm when applying the maximum load in penetration and impact fatigue tests and a flexural stiffness of 300 to 2,000 MPa;

the intermediate layer is formed from a material selected from the group consisting of polyurethane-based thermoplastic elastomer, polyamide-based thermoplastic elastomer, polycarbonate resin, polyacetal resin, and a modified compound thereof; and the cover is formed from thermoplastic resin.

2. The multi-piece solid golf ball according to claim 1, wherein the intermediate layer is formed from a material having an elongation of 9 to 16 mm when applying the maximum load in penetration and impact fatigue tests and stiffness of 350 to 1,500 MPa.

3. The multi-piece solid golf ball according to claim 1, wherein the intermediate layer has a thickness of 0.3 to 2.0 mm.

4. The multi-piece solid golf ball according to claim 1, wherein the intermediate layer is formed from polycarbonate resin.

5. The multi-piece solid golf ball according to claim 1, wherein the intermediate layer is formed from polyacetal resin.

6. The multi-piece solid golf ball according to claim 1, wherein the intermediate layer is formed from one material.

7. The multi-piece solid golf ball according to claim 1, wherein the intermediate layer is formed from a material having an elongation of 10 to 12 mm when applying the maximum load in penetration and impact fatigue tests and a flexural stiffness of 400 to 1,300 MPa.

8. The multi-piece solid golf ball according to claim 1, wherein the intermediate layer has a thickness of 0.5 to 1.8 mm.

9. The multi-piece solid golf ball according to claim 1, wherein the intermediate layer has a thickness of 0.8 to 1.5 mm.

10. The multi-piece solid golf ball according to claim 1, wherein the cover has a Shore D hardness of 22 to 55.

11. The multi-piece solid golf ball according to claim 1, wherein the cover has a Shore D hardness of 25 to 52.

* * * * *